US007896618B2

(12) United States Patent
Higashimori et al.

(10) Patent No.: US 7,896,618 B2
(45) **Date of Patent: *Mar. 1, 2011**

(54) CENTRIFUGAL COMPRESSING APPARATUS

(75) Inventors: Hirotaka Higashimori, Nagasaki-ken (JP); Hiroshi Kuma, Nagasaki-ken (JP); Ryoma Nogami, Aichi-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 119 days.

This patent is subject to a terminal disclaimer.

(21) Appl. No.: 12/330,856

(22) Filed: Dec. 9, 2008

(65) Prior Publication Data

US 2009/0092486 A1 Apr. 9, 2009

Related U.S. Application Data

(62) Division of application No. 11/240,527, filed on Oct. 3, 2005, now Pat. No. 7,476,081.

(51) Int. Cl.
*F04D 29/22* (2006.01)

(52) U.S. Cl. ..... 416/185; 416/228; 416/223 B

(58) Field of Classification Search ..... 416/185, 416/186 R, 228, 223 B, DIG. 2
See application file for complete search history.

(56) References Cited

U.S. PATENT DOCUMENTS

| | | | | |
|---|---|---|---|---|
| 163,710 | A * | 5/1875 | White | 415/218.1 |
| 3,197,124 | A | 7/1965 | Sallou | |
| 3,846,043 | A * | 11/1974 | Wolbrink et al. | 416/183 |
| 3,904,308 | A | 9/1975 | Ribaud | |
| 3,997,281 | A * | 12/1976 | Atkinson | 415/207 |
| 4,093,401 | A * | 6/1978 | Gravelle | 416/185 |
| 6,224,335 | B1 | 5/2001 | Parisi et al. | |
| 6,877,955 | B2 * | 4/2005 | Higashimori et al. | 416/185 |
| 7,476,081 | B2 * | 1/2009 | Higashimori et al. | 416/185 |

FOREIGN PATENT DOCUMENTS

| | | |
|---|---|---|
| JP | 32-2429 | 4/1957 |
| JP | 58195099 A | 11/1983 |
| JP | 7-54796 | 2/1995 |
| JP | 2000-64998 | 3/2000 |

OTHER PUBLICATIONS

Japanese Office Action issued Aug. 26, 2008 in Japanese Application No. 2004-190989.

* cited by examiner

*Primary Examiner*—Ninh H Nguyen
(74) *Attorney, Agent, or Firm*—Wenderoth, Lind & Ponack, L.L.P.

(57) ABSTRACT

In a centrifugal compressing apparatus, a height of a blade of an impeller is made to decrease gradually from a front edge thereof to a rear edge thereof, and a rate of change of the height of the blade is relatively large near the rear edge. The height of the blade can be made large at the rear edge side under the design restriction that an exit width of the rear edge of the blade is set to a predetermined design value. The ratio of the width of the clearance and the height of the blade is thereby made relatively large. As a result, the ratio of a flow path area occupied by a clearance flow to a flow path area occupied by a main flow is reduced. Since the pressure loss is thus made small, a drop in the efficiency can be prevented.

4 Claims, 11 Drawing Sheets

WHEN THE BLADE HEIGHT IS HIGH

WHEN THE BLADE HEIGHT IS LOW

CENTRIFUGAL COMPRESSING APPARATUS

This is a divisional application of U.S. application Ser. No. 11/240,527, filed Oct. 3, 2005 now U.S. Pat. No. 7,476,081.

BACKGROUND OF THE INVENTION

1. Field of the Invention

The present invention relates to a centrifugal compressing apparatus.

2. Description of the Related Art

As shown in FIG. 7, a centrifugal compressing apparatus 10 has an impeller 1 that is driven to rotate by a motor (not shown), etc., and a casing 2 that houses the impeller 1. The impeller 1 has a hub (rotor) 4 that is formed into a substantially conical shape and blades 3 that are mounted radially onto the hub 4. The casing 2 is formed to a substantially conical-cylindrical shape so as to house the impeller 1 across a predetermined clearance CL. The clearance CL is made substantially fixed in value from a front edge side 5 to a rear edge side 6 of the impeller 1.

Reference symbol H denotes the height of the blade 3, and the height H of the blade 3 is made to decrease gradually from the front edge 5 side to the rear edge 6 side of the impeller 1. The height H of the blade 3 is the amount of protrusion of the blade from the hub surface in a direction orthogonal to the main air flow inside the impeller. In the following description, the value obtained by dividing the amount of change of the blade height with respect to the meridional distance along the hub surface by the meridional distance shall be defined as the blade height changing rate.

At the impeller 1 of the centrifugal compressing apparatus 10, there exists a clearance flow that flows in from the clearance CL between a top edge 7 of the blade 3 and the shroud casing 2. The clearance flow (CLF) refers to a phenomenon, wherein, as shown in FIG. 10, a portion of the air at a pressure surface 3*a* of the blade 3 of the impeller 1 flows past the clearance CL between the blade 3 and the casing 2 and into the negative pressure surface 3*b* side of the blade 3.

A modeled flow inside the impeller for an ideal case where the clearance flow CLF does not exist is illustrated in FIG. 8 and FIG. 9. FIG. 8 is a diagram corresponding to a view taken on line A-A of FIG. 7. If, as shown in FIG. 8, it is assumed that the clearance CL does not exist between the blade 3 and the casing 2, the flow velocity distribution (inter-blade flow velocity distribution) of the flow (main flow) flowing in the depth direction orthogonal to the paper surface along the section taken along line B-B of FIG. 8 will, as shown in FIG. 9, be such that the flow velocity decreases gradually from the negative pressure surface 3*b* side to the pressure surface 3*a* side of the blade 3.

Meanwhile, a modeled flow for the case where the clearance flow CLF exists is shown in FIG. 10 and FIG. 11. Since the clearance flow CLF flows substantially perpendicular to the main flow direction as shown in FIG. 10, the flow velocity near the negative pressure surface 3*b* is a mixture of the ideal flow velocity and the substantially zero flow velocity of the clearance flow CLF and thus drops, as shown in FIG. 11, to half the ideal flow velocity shown in FIG. 9. The decrease in flow velocity in the main flow direction resulting from this mixture is a pressure loss.

As shown in FIG. 7, in the impeller 1 of the centrifugal compressing apparatus 10, the height H of the blade 3 decreases from an entrance to an exit in the flow direction. FIG. 12A is a diagram for illustrating a case where the height H of the blade 3 is relatively high, and FIG. 12B is a diagram for illustrating a case where the height H of the blade 3 is relatively low. Since the clearance CL between the blade 3 and the casing 2 is substantially fixed from the front edge 5 side to the rear edge 6 side of the blade 3 as mentioned above, when the height H of the blade 3 decreases, the ratio of the width Δb of the clearance CL to the height H of the blade 3 (Δb/H) becomes relatively large, and thus the ratio of the area occupied by the clearance flow CLF to the area occupied by the main flow becomes large as shown in FIG. 12A and FIG. 12B and thus the pressure loss increases. The pressure loss due to the clearance flow CLF is greater the lower the height H of the blade 3, and is greater at the rear edge 6 side than at the front edge 5 side of the blade 3.

Japanese Published Unexamined Patent Application No. 2000-64998 discloses a centrifugal compressing apparatus, wherein an abradable layer that is abraded by an impeller is provided on an inner surface of a casing that houses the impeller, and with this centrifugal compressing apparatus, when the length from a front edge to a rear edge of the impeller along the inner surface of the casing is M and a length from the front edge of the impeller to an arbitrary position is m, the abradable layer is disposed in the range of M-m, with $0.2 \leqq m/M \leqq 0.4$ being satisfied.

SUMMARY OF THE INVENTION

An object of the present invention is to provide a centrifugal compressing apparatus having low pressure loss and that can restrain the loss of efficiency.

According to an aspect of the present invention, in a centrifugal compressing apparatus, a height of a blade of an impeller is made to decrease gradually from a front edge thereof to a rear edge thereof, and an absolute value of a rate of change of the height of the blade is relatively large near the rear edge.

According to another aspect of the present invention, in a centrifugal compressing apparatus, at a top edge of a blade of an impeller, a shroud line of a shroud surface that opposes a casing that houses the impeller is made convex in a direction of increasing a height of the blade beyond a tangent drawn to the shroud line from a point of an exit width from a hub surface along a rear edge of the blade and towards an interior of the blade, at a rear edge of the blade with respect to an intersection of the tangent and the shroud line. Here, the point of the exit width from the hub surface on the rear edge of the blade may be a point that is separated from the hub surface on the rear edge of the blade by just the exit width.

According to still another aspect of the present invention, in a centrifugal compressing apparatus, at a base end of a blade of an impeller, a hub line that is a boundary with respect to a hub onto which the blade is mounted is made concave in a direction of increasing a height of the blade beyond a radial line drawn in a radial direction of the impeller from an intersection of a rear edge of the blade and the hub line.

According to still another aspect of the present invention, in a centrifugal compressing apparatus, a height of a blade of an impeller is made to decrease gradually from a front edge to a rear edge, and a rate of change of the height of the blade has at least one inflection point.

The above and other objects, features, advantages and technical and industrial significance of this invention will be better understood by reading the following detailed description of presently preferred embodiments of the invention when considered in connection with the accompanying drawings.

DETAILED DESCRIPTION OF THE PREFERRED EMBODIMENTS

Embodiments of a centrifugal compressing apparatus according to the present invention shall now be described in detail with reference to the drawings.

In the following embodiments, portions in common to those of the conventional art described above shall be provided with reference symbols in common and detailed description thereof shall be omitted.

Figure 12A:
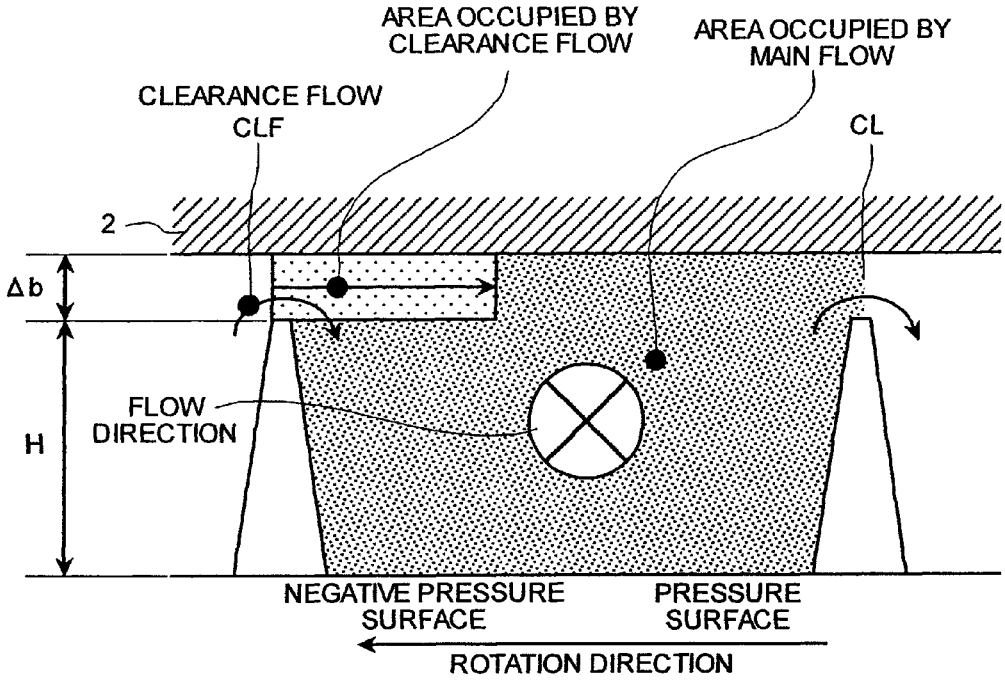
FIG. 12A is a diagram of the ratio of the area occupied by a clearance flow and the area occupied by a main flow when the blade height is high.
Figure 12B:
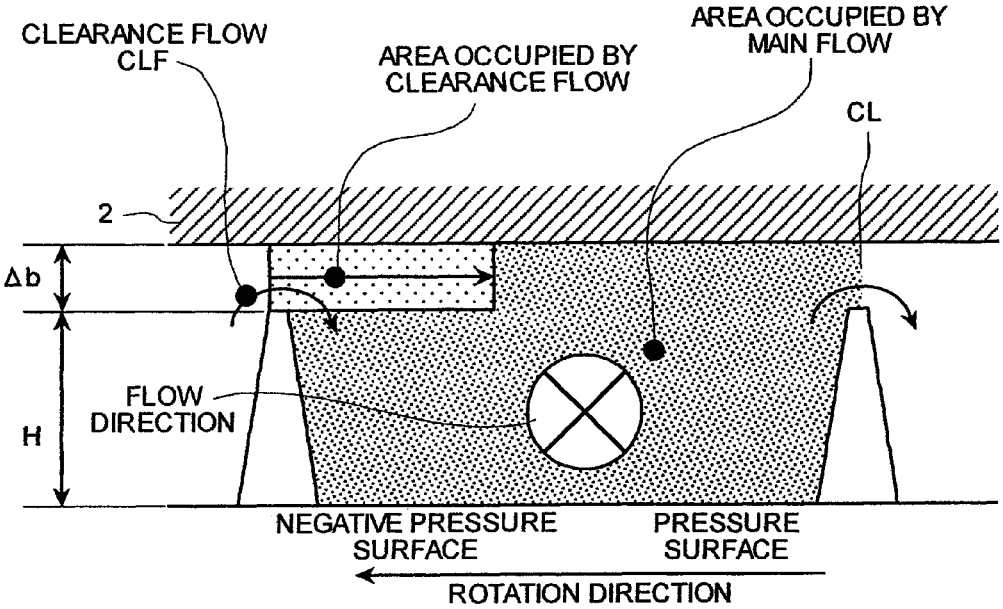
FIG. 12B is a diagram of the ratio of the area occupied by a clearance flow and the area occupied by a main flow when the blade height is low.

As described with reference to FIG. 12A and FIG. 12B, an object of these embodiments is to reduce pressure loss at a rear edge 6 side of a blade 3 at which the pressure loss is relatively large and thereby effectively restrain the lowering of the efficiency of the centrifugal compressing apparatus.

First Embodiment

Figure 1:
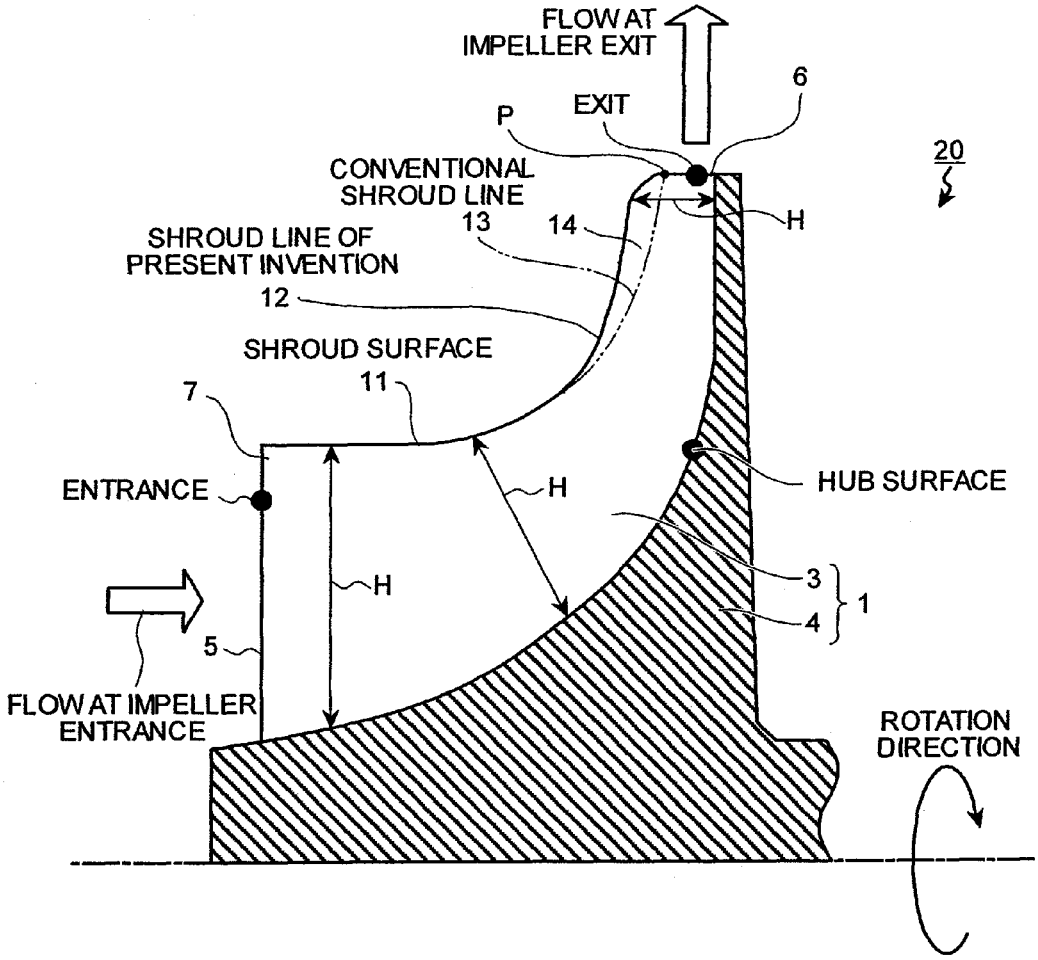
FIG. 1 is a sectional side view of an impeller of a centrifugal compressing apparatus of a first embodiment of the present invention.

A first embodiment shall now be described with reference to FIG. 1 and FIG. 2. FIG. 1 is a side view of an impeller 1 of a centrifugal compressing apparatus 20 according to a first embodiment, and FIG. 2 is an enlarged view of the principal portions.

Figure 7:
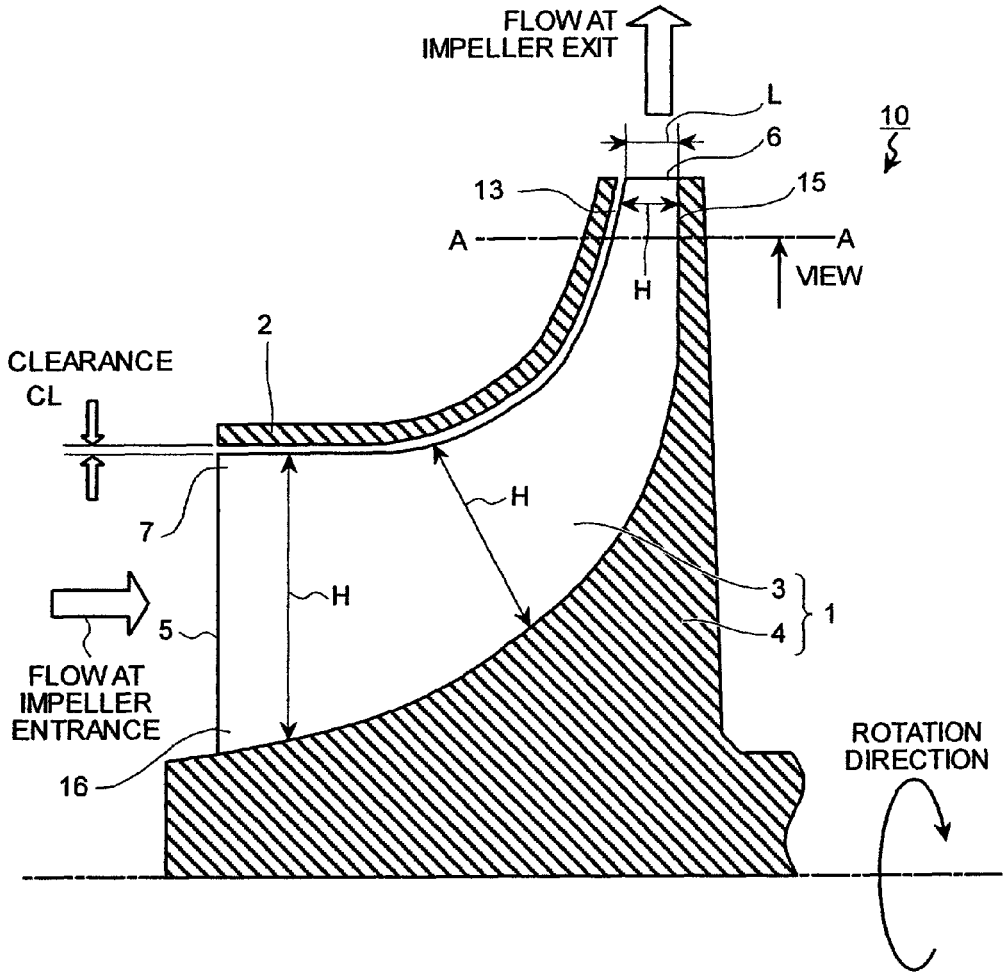
FIG. 7 is a sectional side view of an impeller of a conventional centrifugal compressing apparatus.
Figure 8:
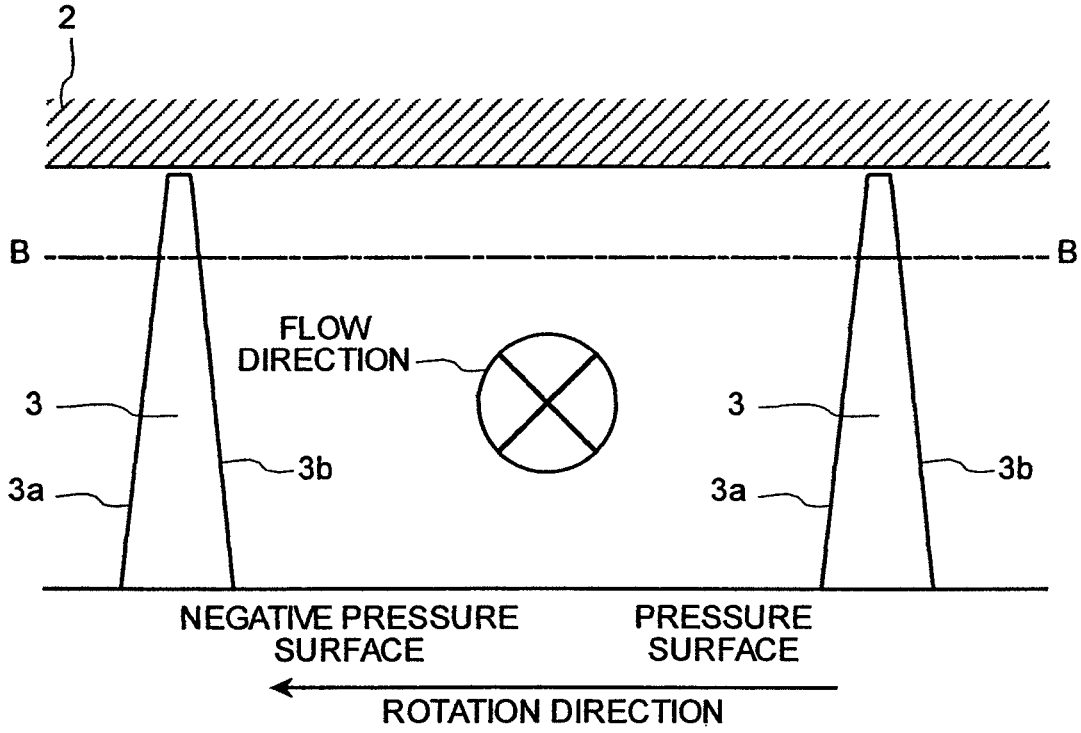
FIG. 8 is a view taken on A-A of FIG. 7 and is a diagram of a modeled flow for an ideal case where a clearance flow does not exist.
Figure 9:
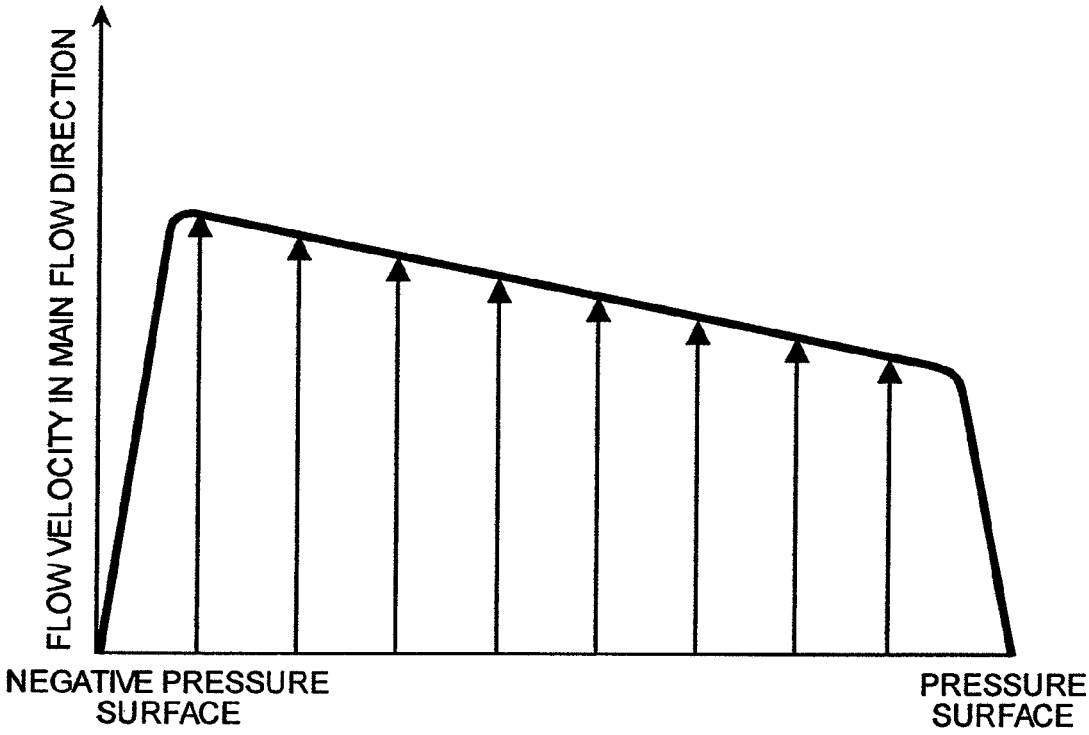
FIG. 9 is a diagram of an inter-blade flow velocity distribution along line B-B of FIG. 8.
Figure 10:
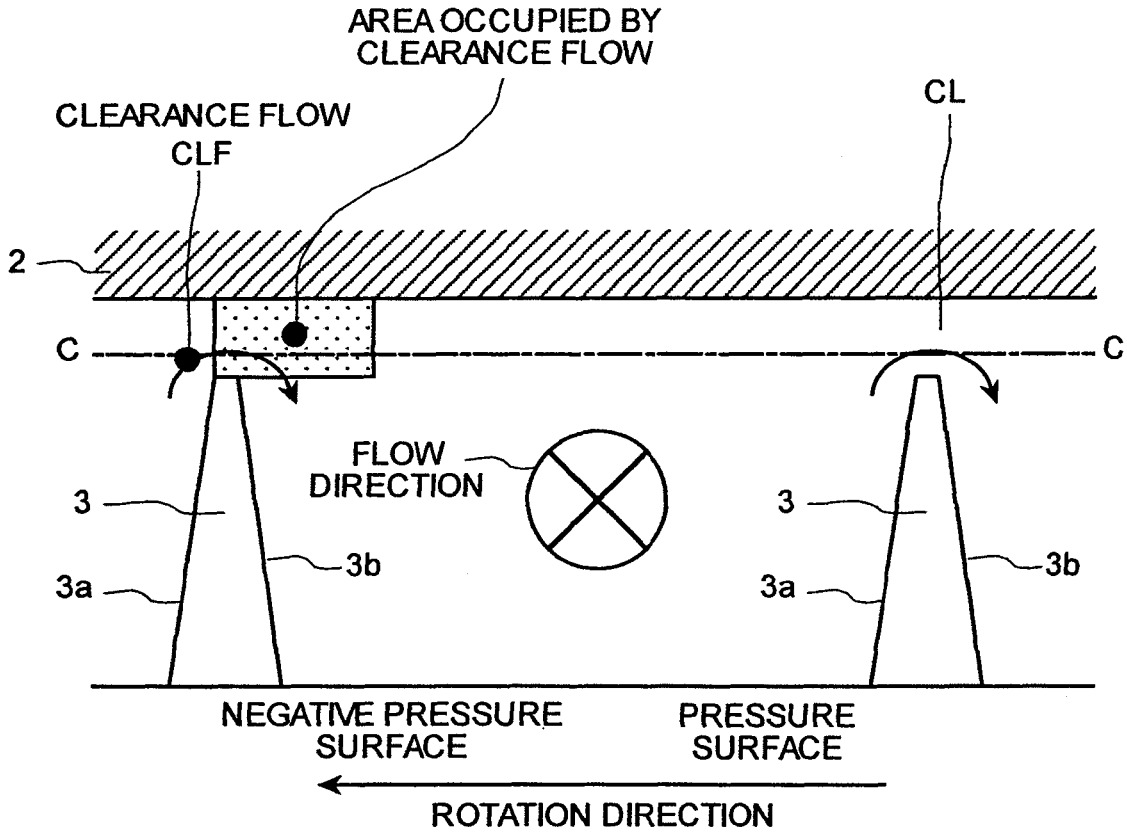
FIG. 10 is a view taken on A-A of FIG. 7 and is a diagram of a modeled flow for a case where a clearance flow exists.
Figure 11:
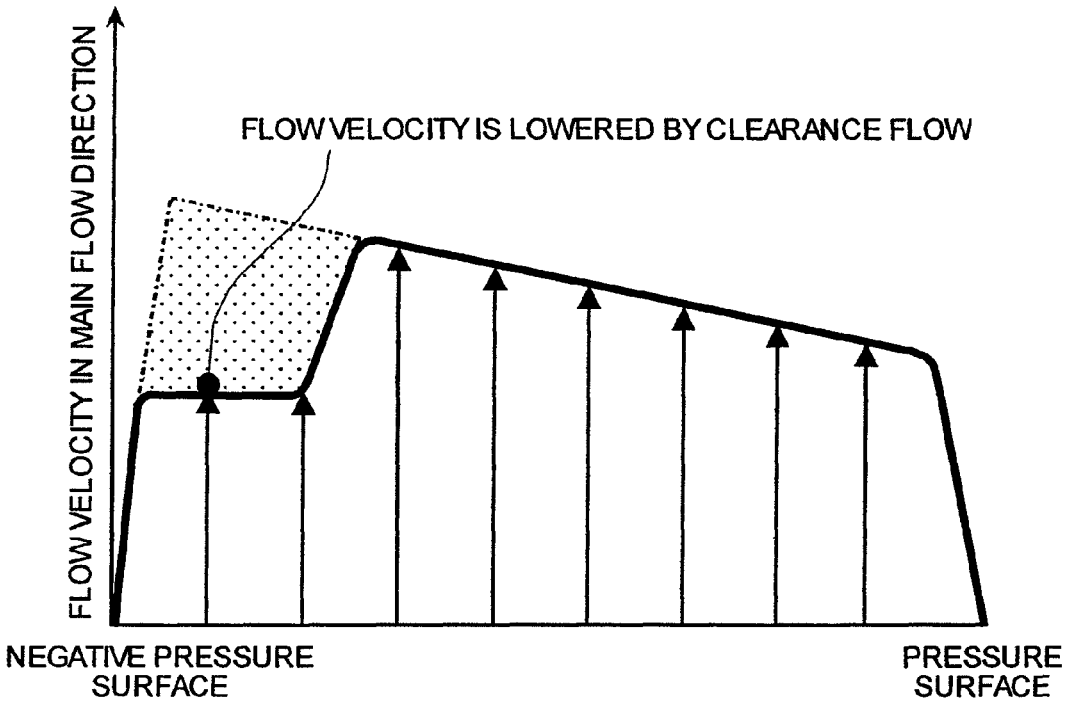
FIG. 11 is a diagram of an inter-blade flow velocity distribution along line C-C of FIG. 10.

As shown in FIG. 1, a line (shroud line) 12 of a shroud surface 11 of the blade 3 that opposes a casing (not shown) at a top edge 7 side of the blade 3 is formed so as to bulge in the direction of expanding the height H of the blade 3 in comparison to a shroud line 13 of the conventional centrifugal compressing apparatus 10 of FIG. 7. With the blade 3, the bulged portion (convex portion) is indicated by reference symbol 14. By the blade 3 having the convex portion 14, the height H of the blade 3 is made higher than in the conventional arrangement.

Figure 2:
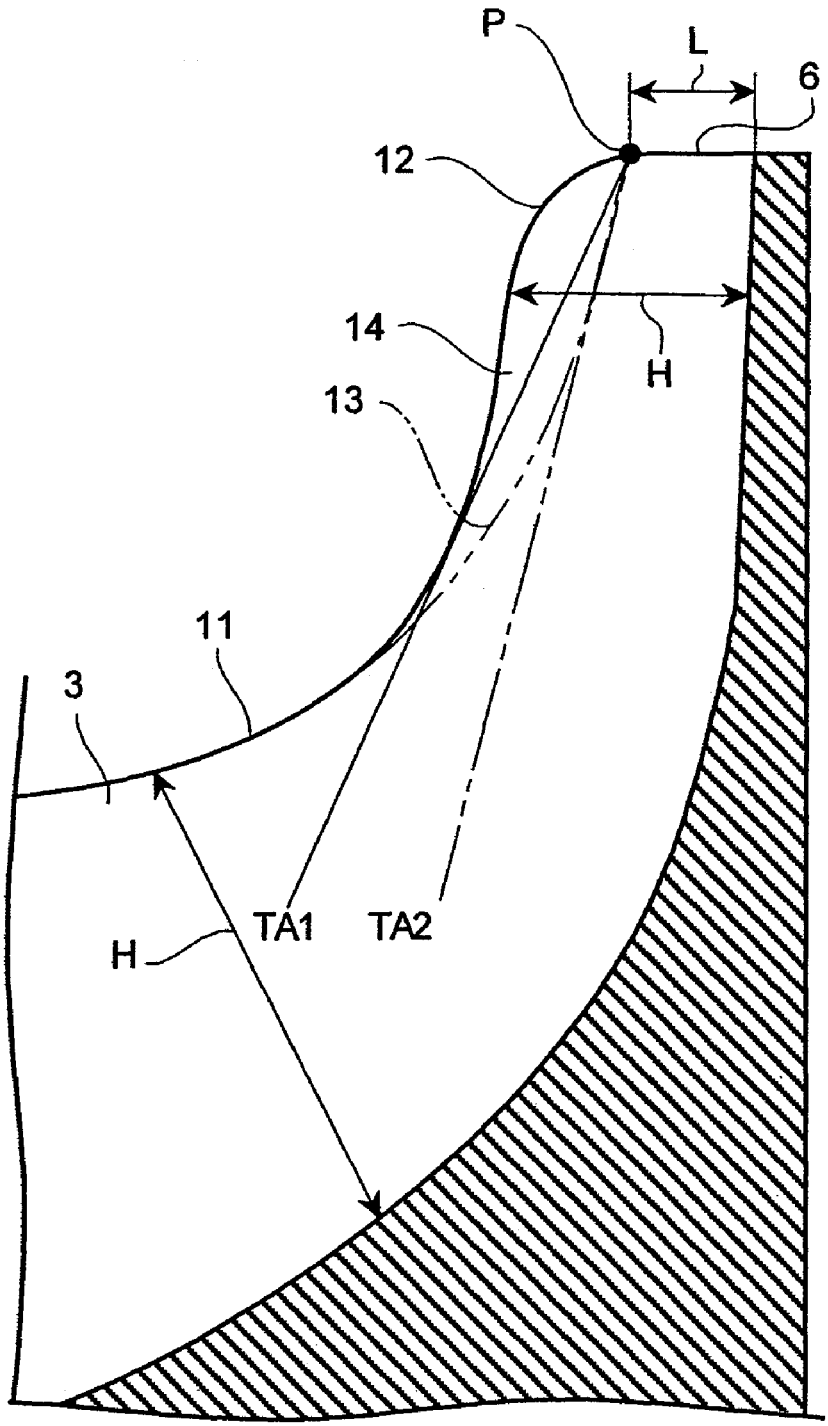
FIG. 2 is an enlarged view of FIG. 1.

In FIG. 2, reference symbol TA1 denotes, in the blade 3 of the centrifugal compressing apparatus 20, a tangent that is drawn starting from a point P, located at a distance of an exit width L to the shroud side from a hub line at the rear edge of the blade 3, to the shroud line 12 in the upstream direction in the interior of the blade 3. The point P is the intersection of the shroud line 12 and the rear edge of the blade 3. The blade 3 of the centrifugal compressing apparatus 20 has the convex portion 14, which bulges in the direction of enlarging the height H of the blade 3 beyond the tangent TA1, at the rear edge 6 side of the intersection of the shroud line 12 and the tangent TA1. In the conventional centrifugal compressing apparatus 10, the height H of the blade 3 is relatively low at the rear edge 6 side of the blade 3 so that the pressure loss due to the clearance flow CLF becomes a problem. However, in the centrifugal compressing apparatus 20 of the first embodiment, the convex portion 14 is provided at the rear edge 6 side of the blade 3 so that the pressure loss due to the clearance flow CLF is reduced effectively.

Reference symbol TA2 denotes a tangent drawn from point P to the shroud line 13 of the conventional centrifugal compressing apparatus 10 of FIG. 7. Because the blade 3 of the centrifugal compressing apparatus 10 does not have a convex portion that bulges in the direction of enlarging the height H of the blade 3 beyond the tangent TA2, the blade 3 is low in height H in comparison to the blade 3 of the centrifugal compressing apparatus 20 and is large in pressure loss due to the clearance flow CLF.

In regard to the meridional shape of the exit portion of the impeller 1 of the centrifugal compressing apparatus 20 of the first embodiment, whereas the conventional shroud line 13 is concave in the height H direction of the blade 3 from the hub 4 along the shroud direction, the shroud line 12 of the first embodiment is convex. By making the shroud line 12 convex with respect to the conventional impeller 1 with the same exit width L (FIG. 2 and FIG. 7) as the impeller 1 of the centrifugal compressing apparatus 20, the height H of the blade 3 can be made high at an intermediate portion between the entrance and the exit of the impeller 1 (with the first embodiment, the portion at the exit side at which the pressure loss is especially high).

Thus, in the centrifugal compressing apparatus 20 of the first embodiment, the ratio of the width $\Delta b$ of the clearance CL to the height H of the blade 3 ($\Delta b/H$) is relatively small in comparison to that of the conventional centrifugal compressing apparatus 10. As a result, the ratio of the flow path area occupied by the clearance flow CLF to the flow path area occupied by the main flow is increased, and since the pressure loss is thus made small, the lowering of the efficiency can be prevented.

As with the conventional centrifugal compressing apparatus 10 shown in FIG. 7, the clearance CL between the casing and the impeller 1 is set to a substantially fixed value from the front edge 5 side to the rear edge 6 side of the blade 3 in the centrifugal compressing apparatus 20 of the first embodiment as well. With the first embodiment, the shape of the casing of the centrifugal compressing apparatus 20 is formed (though not illustrated) so that the clearance CL will be of a substantially fixed value from the front edge 5 side to the rear edge 6 side of the blade 3 according to the blade 3 having the convex portion 14 and the blade 3 having a shape such that the height H of the blade 3 is higher than that of the conventional arrangement (the blade 3 of FIG. 7).

Though the respective embodiments of the present invention that shall be described below also share the feature that the height H of the blade 3 of the impeller 1 changes so as to decrease gradually from the front edge 5 side to the rear edge 6 side of the blade 3 as in the conventional arrangement, these embodiments have the characteristic of being arranged in such a manner that while the blade 3 is provided with an adequate blade height even at the rear edge side so that the proportion occupied by the clearance flow CLF will be small, an inflexion point is provided in the blade height changing rate in order to smoothly guide air to the impeller exit that is made relatively narrow. That is, when an ordinate is set to the blade height and an abscissa is set to the meridional distance from the front edge of a blade along the hub surface, whereas the conventional blade shape will be a monotonously decreasing curve that is convex towards the lower side, with the respective embodiments of the present invention, the curve will be convex towards the lower side at the front edge side, be convex towards the upper side at the rear edge side (and more convex towards the lower side near the rear edge), and have an inflection point in between.

The above embodiment may be summarized as follows.

Basic Principle

A basic principle of the first embodiment is that by making the proportion of the clearance CL with respect to the height H of the blade 3 small, the leakage loss is decreased and the efficiency is improved. Since priorly, the absolute value of the clearance CL was decreased to 1) decrease the absolute value of the leakage amount and 2) make the ratio of the clearance CL to the height H of the blade 3 small. Meanwhile, with the first embodiment, since the absolute value of the clearance CL can be made small by the conventional means, measures are taken to make the height H of the blade 3 high and thereby make small the ratio of the clearance CL to the height H of the blade 3 to reduce the leakage loss.

Additional Effect

The following additional effect is provided by the first embodiment.

Figure 3:
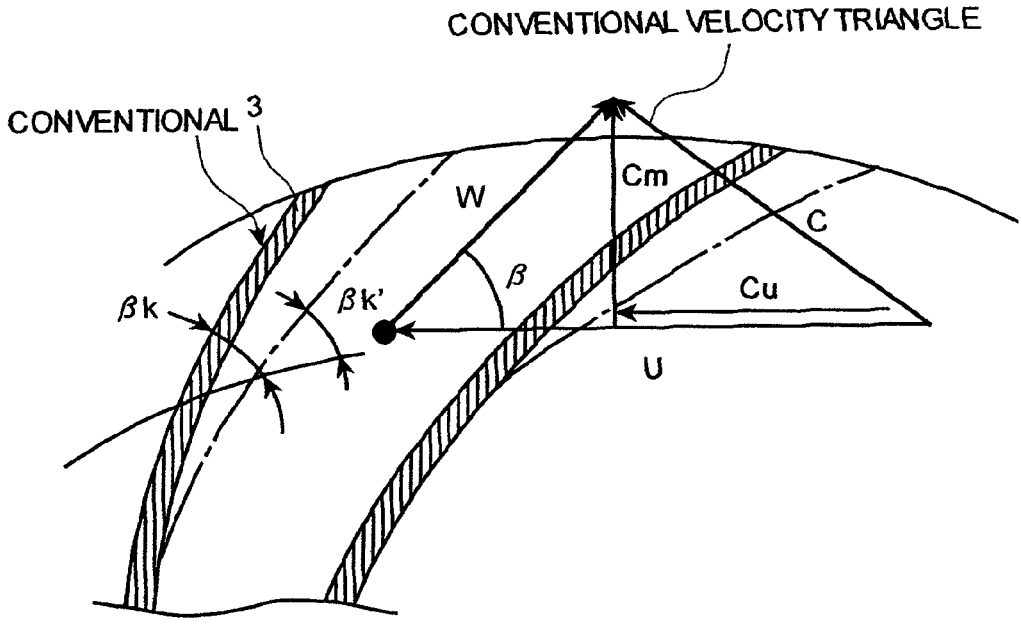
FIG. 3 is a diagram of a velocity triangle of a conventional impeller.
Figure 4:
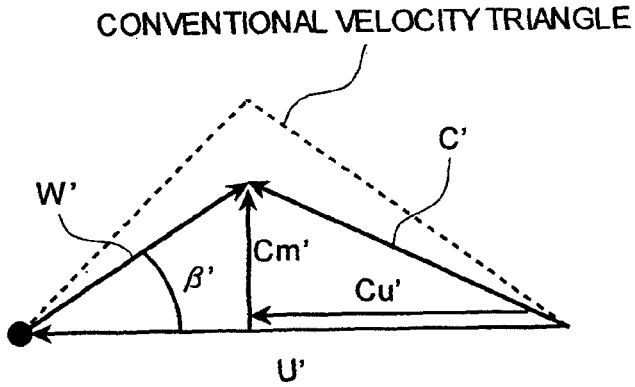
FIG. 4 is a diagram of a velocity triangle of the impeller of the first embodiment.

FIG. 3 is a diagram of the blade 3 of the conventional centrifugal compressing apparatus 10. In FIG. 3, the reference symbol U denotes the rotation direction velocity of the impeller 1, the reference symbol W denotes the relative flow velocity, and the reference symbol C denotes the absolute flow velocity. By these, the velocity triangle shown in FIG. 3 is formed. FIG. 4 is a diagram of the velocity triangle of the impeller 1 of the centrifugal compressing apparatus 20 of the embodiment, and in FIG. 4, the velocity triangle of the impeller 1 of the conventional centrifugal compressing apparatus 10 is depicted by the broken lines.

As shown in FIG. 3 and FIG. 4, with the impeller 1 of the centrifugal compressing apparatus 20, by increasing the height H of the blade 3 by just the amount of convex portion 14, the Cm within the velocity triangle decreases to Cm', given that the flow rate is the same. In order to keep the work fixed (keep the pressure fixed), Cu'=Cu must be satisfied, and for this, modification is made to make the blade angle $\beta k' < \beta k$ so that the flow angle $\beta' < \beta$ (see FIG. 3).

Consequently with the centrifugal compressing apparatus 20 of the first embodiment, the absolute flow velocity C' also decreases in comparison to the conventional centrifugal compressing apparatus 10. Since this absolute flow velocity C' generates frictional loss with the casing, the loss of the impeller 1 is reduced by this reduction of the absolute flow velocity C'.

Thus as an additional effect of the first embodiment, by decreasing of the blade angle $\beta k$, the frictional loss can be reduced to restrain the reduction of the efficiency of the centrifugal compressing apparatus 20.

Second Embodiment

A second embodiment shall now be described with reference to FIG. 5.

In the second embodiment, description of portions in common to the first embodiment shall be omitted and only the characteristic portions of the second embodiment shall be described.

Figure 5:
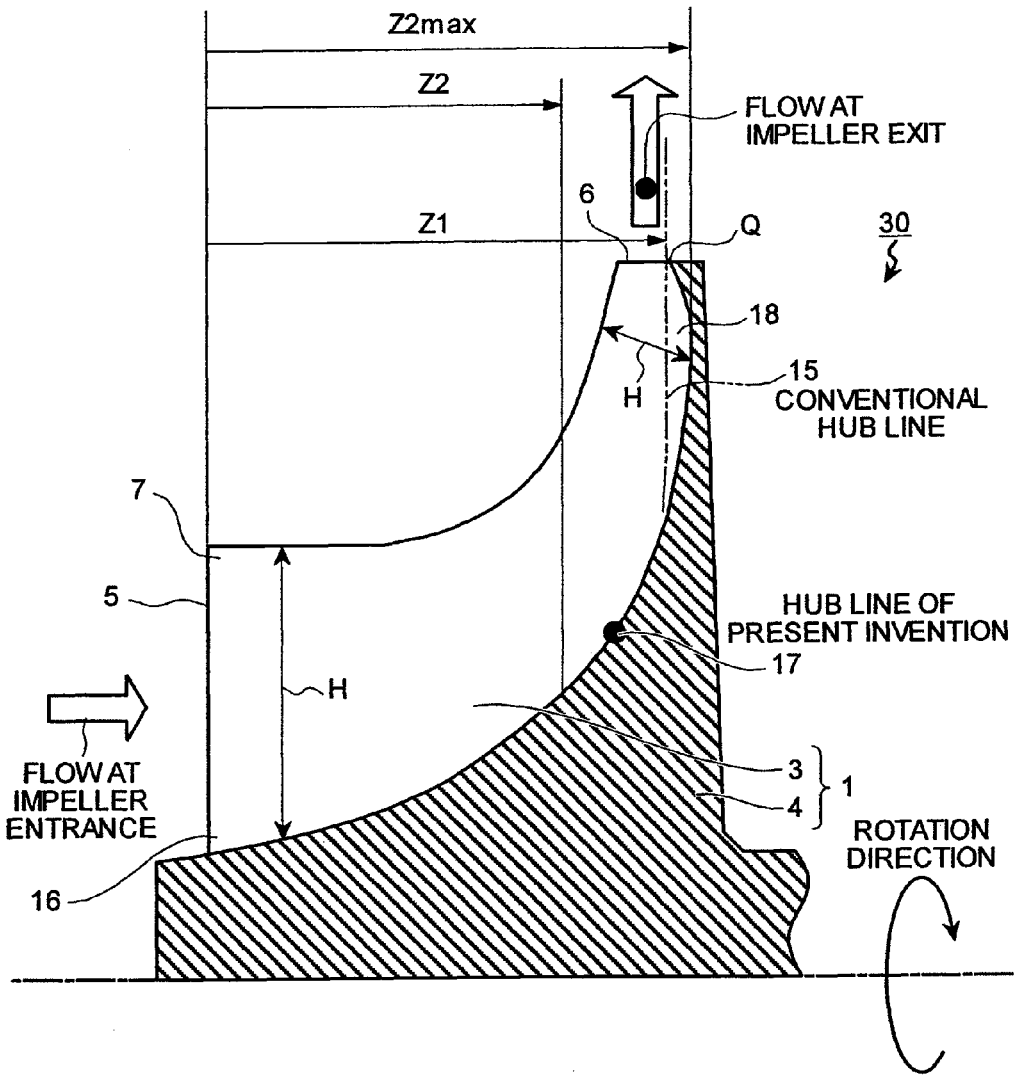
FIG. 5 is a sectional side view of an impeller of a centrifugal compressing apparatus of a second embodiment of the present invention.

As shown in FIG. 5, with a centrifugal compressing apparatus 30 of the second embodiment, a hub line 17, at a base end 16 side that is the side of the blade 3 that is mounted to the hub 4, is formed so as to be depressed in the direction of increasing the height H of the blade 3 in comparison to a hub line 15 of the conventional centrifugal compressing apparatus 10 of FIG. 7. The portion of difference (concave portion) of the blade 3 is denoted by the reference symbol 18. The blade 3 has the convex portion 18 and the height H of the blade 3 is thereby made greater than that in the conventional arrangement. The hub line 17 is the boundary between the base end 16 of the blade 3 of the impeller 1 and the hub 4 onto which the base end 16 of the blade 3 is mounted.

In FIG. 5, the conventional hub line denoted by the reference symbol 15 is, at the same time, a segment (radial line) in the radial direction of the hub 4 that passes through a point Q at the hub 4 side of the exit width L of the rear edge 6 of the blade 3. The point Q is the intersection of the hub line 17 and the rear edge 6 of the blade 3. The blade 3 of the centrifugal compressing apparatus 30 has the convex portion 18 that bulges in the direction of enlarging the height H of the blade 3 beyond the radial line 15 that passes through the point Q. Whereas the height H of the blade 3 is relatively low at the rear edge 6 side of the blade 3 of the conventional centrifugal compressing apparatus 10 and the pressure loss due to the clearance flow CLF becomes a problem in particular, with the centrifugal compressing apparatus 30, the convex portion 18 is provided at the rear edge 6 side of the blade 3. The pressure loss due to the clearance flow CLF is thereby reduced effectively. Since the conventional centrifugal compressing apparatus 10 does not have a convex portion that bulges in the direction of enlarging the height H of the blade 3 beyond the hub line 15, the height H of the blade 3 is low in comparison to the blade 3 of the centrifugal compressing apparatus 30 and the pressure loss due to the clearance flow CLF is large.

In regard to the meridional shape of the impeller 1 of the conventional centrifugal compressing apparatus 10, with respect to an axial length Z1 of the hub line 15 from the front edge 5 to the rear edge 6 of the impeller 1, an axial length Z2 from the front edge 5 of the impeller 1 at an intermediate portion between the front edge 5 and the rear edge 6 of the impeller 1 is such that $Z1 \geqq Z2$. Meanwhile, with the second embodiment, with respect to the axial length Z1 from the front edge 5 to the rear edge 6 of the impeller 1, a maximum value Z2max of the axial length Z2 from the front edge 5 of the impeller 1 at an intermediate portion is such that $Z1 < Z2max$.

By making the maximum value of the length in the axial direction of the impeller 1 at an intermediate portion between the front edge 5 and the rear edge 6 of the impeller 1 satisfy $Z1 < Z2max$, the height H of the blade 3 can be made high at an intermediate portion between the front edge 5 and the rear edge 6 of the impeller 1. The ratio ($\Delta b/H$) of the width $\Delta b$ of the clearance CL and the height H of the blade 3 is thereby made relatively large. As a result, the ratio of the flow path area occupied by the clearance flow CLF to the flow path area occupied by the main flow is reduced and since the pressure loss is thus made small, the lowering of the efficiency can be prevented. The above-described additional effect obtained in the first embodiment is also obtained in the second embodiment.

As shown in FIG. 1 and FIG. 5, in both the first embodiment and the second embodiment, though the height H of the blade 3 of the impeller 1 is made to change in a gradually decreasing manner from the front edge 5 side to the rear edge 6 side of the blade 3 as in the conventional arrangement, the embodiments are characterized in being arranged so that the changing rate of the height H of the blade 3 becomes relatively large near the rear edge 6 of the blade 3. That is, both the first embodiment and the second embodiment have the arrangement where the height H of the blade 3 is secured to be as high as possible until immediately before the exit of the impeller 1 and the flow path is constricted sharply near the exit than at other portions. As a result, the height H of the blade 3 can be made large at the rear edge 6 side under the design restriction of setting the exit width of the rear edge 6 of the blade 3 to the predetermined design value L.

Third Embodiment

Figure 6:
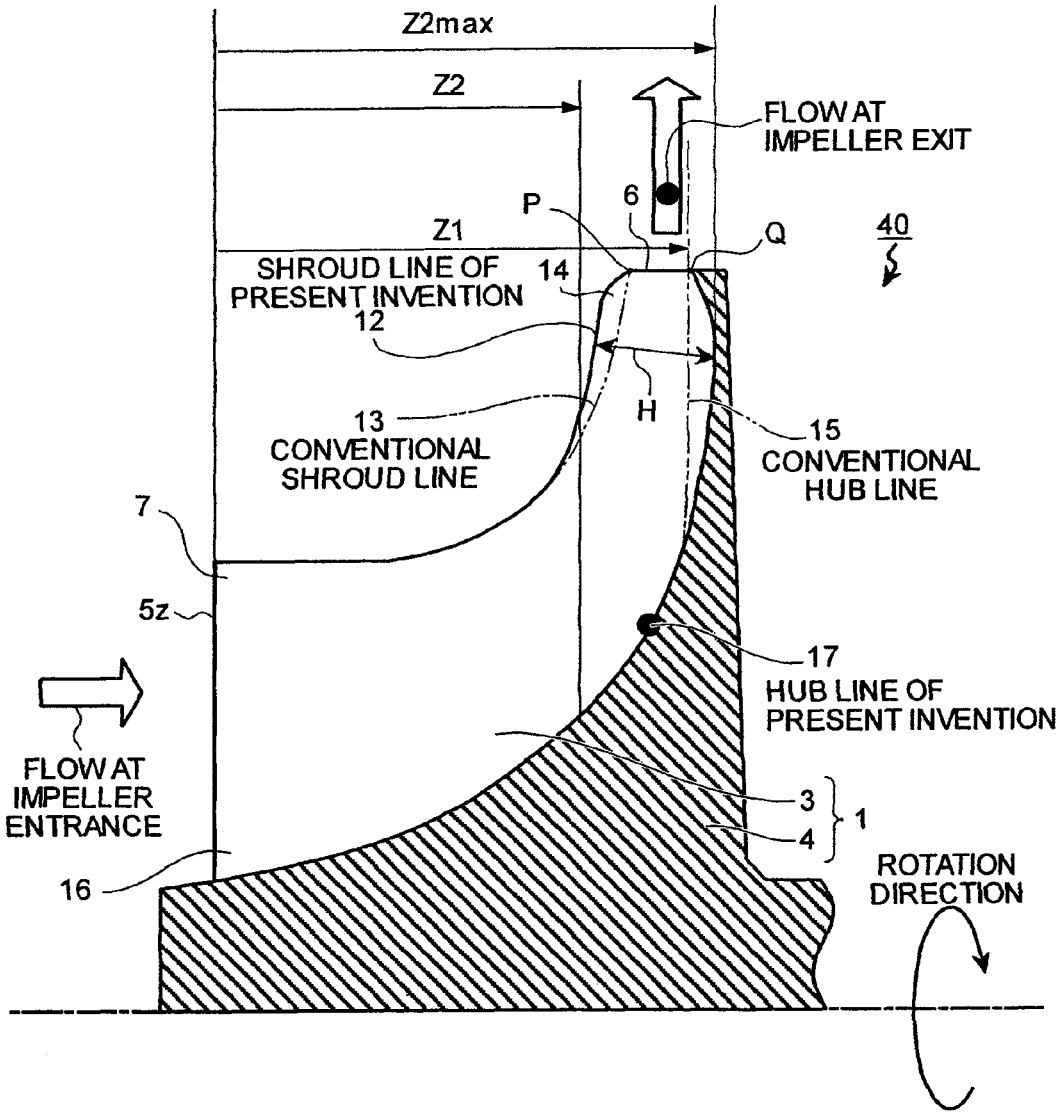
FIG. 6 is a sectional side view of an impeller of a centrifugal compressing apparatus of a third embodiment of the present invention.

A third embodiment shall now be described with reference to FIG. 6.

In the third embodiment, description of portions in common to the above-described embodiments shall be omitted and only the characteristic portions of the third embodiment shall be described.

With a centrifugal compressing apparatus 40 of the third embodiment, the blade 3 has both the convex portion 14 of the first embodiment and the convex portion 18 of the second embodiment. The third embodiment can therefore exhibit the actions and produce the effects of both the first embodiment and the second embodiment.

As described above, in each of the first to third embodiments, by changing the exit shape of the impeller 1 and thereby making the height H of the blade 3 high at an intermediate portion, the ratio ($\Delta b/H$) of the width of the clearance CL and the height H of the blade 3 is made relatively small. As a result, the ratio of the flow path area occupied by the clearance flow CLF to the flow path area occupied by the main flow is reduced and since the pressure loss is thus made small, the lowering of the efficiency of the centrifugal compressing apparatus can be prevented.

What is claimed is:

1. A centrifugal compressing apparatus comprising:

an impeller having a hub having a hub surface and an impeller blade extending along said hub surface, said impeller having an impeller flow entrance and an impeller flow exit, wherein a height of the impeller blade of said impeller is configured to decrease gradually from a front edge thereof to a rear edge thereof; and a casing configured to house the impeller, wherein the impeller blade has a shroud surface having a shroud line configured to oppose the casing, wherein the shroud line is configured to be convex at a rear edge of the impeller blade with respect to an intersection of a tangent drawn to the shroud line from a point P of an exit width L and the shroud line, wherein the point P is an intersection of said shroud line with said rear edge of said impeller blade, said rear edge having a length forming a flow exit width of said impeller, wherein said shroud line and point P are defined in a meridional surface.

2. The centrifugal compressing apparatus according to claim 1, wherein the impeller blade is configured to have a convex portion bulging in the direction of enlarging the height of the impeller blade beyond a tangent TA1 at the rear edge of the impeller blade.

3. A centrifugal compressing apparatus comprising:

an impeller having a hub having a hub surface and an impeller blade extending along said hub surface, said impeller having an impeller flow entrance and an impeller flow exit such that a main air flow flows inside said impeller from said impeller flow entrance to said impeller flow exit, wherein a height of the impeller blade of said impeller decreases gradually and continuously from a front edge thereof to a rear edge thereof, said height being an amount of protrusion of said impeller blade from said hub surface in a direction orthogonal to the main air flow inside said impeller; and a casing configured to house the impeller, wherein the impeller blade has a shroud surface having a shroud line configured to oppose the casing, wherein the shroud line is configured to be convex at a rear edge of the impeller blade with respect to an intersection of a tangent drawn to the shroud line from a point P of an exit width L and the shroud line, wherein the point P is an intersection of said shroud line with said rear edge of said impeller blade, said rear edge having a length forming a flow exit width of said impeller, wherein said shroud line and point P are defined in a meridional surface.

4. The centrifugal compressing apparatus according to claim 3, wherein the impeller blade is configured to have a convex portion bulging in the direction of enlarging the height of the impeller blade beyond a tangent TA1 at the rear edge of the impeller blade.

* * * * *